United States Patent [19]

Ishii et al.

[11] 4,434,716

[45] Mar. 6, 1984

[54] OPERATING LEVER DEVICE FOR PRINTING MACHINE

[75] Inventors: Koji Ishii; Yoshinori Honkawa, both of Hiroshima, Japan

[73] Assignee: Ryobi Ltd., Fuchu, Japan

[21] Appl. No.: 265,497

[22] Filed: May 20, 1981

[30] Foreign Application Priority Data

May 27, 1980 [JP] Japan ..... 55-71148

[51] Int. Cl.[3] ..... B41F 7/06

[52] U.S. Cl. ..... 101/142; 101/144

[58] Field of Search ..... 101/141-144

[56] References Cited

U.S. PATENT DOCUMENTS

| | | | |
|---|---|---|---|
| 3,858,508 | 1/1975 | Kaneko et al. | 101/148 |
| 3,956,985 | 5/1976 | Ishii | 101/142 |
| 4,027,588 | 6/1977 | Tasaka et al. | 101/144 |

*Primary Examiner*—William Pieprz

*Attorney, Agent, or Firm*—Sughrue, Mion, Zinn, Macpeak & Seas

[57] ABSTRACT

An offset printing machine including an operating lever mechanism in which, before the printing process is started, all required preliminary processes can be carried out while the operator can visually confirm them to thereby prevent unsatisfactory printing operations due to erroneous plate insertion. The operating lever is rigidly coupled to an operating shaft upon which are mounted cams and arms for controlling each of a plate loading device, a plate unloading device, a blanket cylinder cleaning device, a form roller control mechanism, a plate cylinder control mechanism, a sheet feed control mechanism, a water duct roller control mechanism and an ink duct roller control mechanism in accordance with the angular position of the operating shaft. The plate loading device includes a switch structure having a memory circuit adapted to be set to open and closed positions in accordance with a plate loading operation and to store a plate loaded state even during a restoring operation which is carried out upon completion of the plate loading operation.

13 Claims, 13 Drawing Figures

OPERATING LEVER DEVICE FOR PRINTING MACHINE

BACKGROUND OF THE INVENTION

The present invention relates to an operating lever device for an offset press in which a series of processes from a plate loading process through a printing process to a blanket cylinder cleaning process are carried out with one operating lever.

Referring to FIG. 1, an offset press 3 includes a plate cylinder, a rubber blanket cylinder 4, and a impression cylinder 5. After an original plate 188 has been loaded onto the plate cylinder 3 by operation of a plate loading device 1, the surface of the plate 188 is coated with moisture supplying solution and ink by a solution supplying device 17 and an inking device 17*a*. The image of the original plate 188 is transferred onto the rubber blanket cylinder 4 and then printed on a printing sheet which is fed between the rubber cylinder 4 and the compression cylinder 5 by a sheet feeding device 15. After the printing operation, the original plate 188 is unloaded from the plate cylinder 3 and then the rubber blanket cylinder 4 is cleaned by a blanket cylinder cleaning device 2.

Recently, an offset press has been developed in which, after a plate has been loaded on the plate cylinder 3, the remaining processes are automatically carried under the control of a logic circuit. In that offset press, the degree of inking is set before the plate 188 is loaded onto the plate cylinder 3. The degree of inking corresponds to the number of revolutions of the plate cylinder 3 during the time interval which elapses from the instant that form rollers 6 and 7 contact the surface of the plate until the plate contacts the rubber blanket cylinder. The degree of inking further corresponds to the number of revolutions of the plate cylinder during the time interval which elapses from the instant that the plate contacts the rubber blanket cylinder 4 (hereinafter referred to merely as "a rubber cylinder 4", when applicable) until a printing sheet is fed. However, in view of the conditions of the printing machine as well as the skill of the operator, frequently the number of cycles set is too many or too few. Furthermore, sometimes a so-called "insertion error" wherein an original plate 188 is not loaded in place on the plate cylinder 3 may occur. In addition, if a creased original plate 188 is used or an original plate 188 is creased during a plate loading process, the next process is carried out with the creased original plate. Accordingly, the resultant print is undoubtedly unsatisfactory. In this case, it is necessary to remove the plate and to clean the rubber cylinder 4. This removal and cleaning operation is troublesome, wasting time and labor. Thus, the conventional offset press involves a variety of problems yet to be solved.

SUMMARY OF THE INVENTION

In view of the foregoing, an object of the invention is to provide an operating lever device for a printing machine in which, before the printing process is started, the required preliminary processes are carried out while the operator can visually confirm them to prevent an unsatisfactory printing operation due to a plate insertion error. Moreover, it is desired to provide such a device wherein, although all the processes up to the printing process are manually controlled, they are carried out with one operating lever which can be operated even by an unskilled operator and yet a satisfactory print result is obtained beginning with the first printing sheet.

More specifically, in accordance with these and other objects of the invention, there is provided a printing machine having an operating lever device including means for loading plates, means for unloading plates, means for cleaning a blanket cylinder, form rollers, a form roller control mechanism, a plate cylinder control mechanism, a sheet feed control mechanism, a water duct roller control mechanism, a rubber cylinder, an ink duct roller control mechanism, and an operating lever device. The operating lever device includes an operating lever adapted to be set at any of a plurality of positions stepwise by a set cam secured to an operating shaft thereof which is secured to the operating lever. The set cam holds the operating lever in such a manner that the operating lever can be held at one of a plurality of predetermined positions. A plurality of cams and arms are coupled to the operating shaft for controlling the plate loading means, the plate unloading means, the blanket cylinder cleaning means, the form roller control mechanism, the plate cylinder control mechanism, the sheet feed control mechanism, the water duct roller control mechanism and the ink duct roller control mechanism in accordance with an angular position of the operating lever. The plate loading device includes a switch mechanism having a memory circuit adapted to be set to open and closed positions in accordance with a plate loading operation so that a plate loaded state is stored even if the offset press is stopped subsequent to an additional completion of a first plate loading operation. An automatic returning mechanism is provided for returning the operating lever to its initial position in a stepwise manner, the automatic returning mechanism includes a solenoid means with the automatic returning mechanism being operated by the solenoid means according to a rotational position of the operating lever. The solenoid means is coupled to be energized upon completion of the printing operation to successively return the operating lever. The automatic returning mechanism is operatively coupled to the operating lever. At least the water duct roller control mechanism and the form roller control mechanism are operatively coupled to the operating lever to be operated before a plate loading operation of the plate loading device by setting the operating lever stepwise to cause the form rollers to contact the plate cylinder. The ink duct roller control mechanism is coupled to the operating shaft in such a manner that ink is supplied, even in a step in which the form rollers contact the surface of the plate and the surface of the plate contacts the rubber cylinder after the plate has been loaded on the plate cylinder.

DESCRIPTION OF THE PREFERRED EMBODIMENTS

A preferred embodiment of an operating lever device for a printing machine according to the invention will be described with reference to the accompanying drawings.

Figure 1:
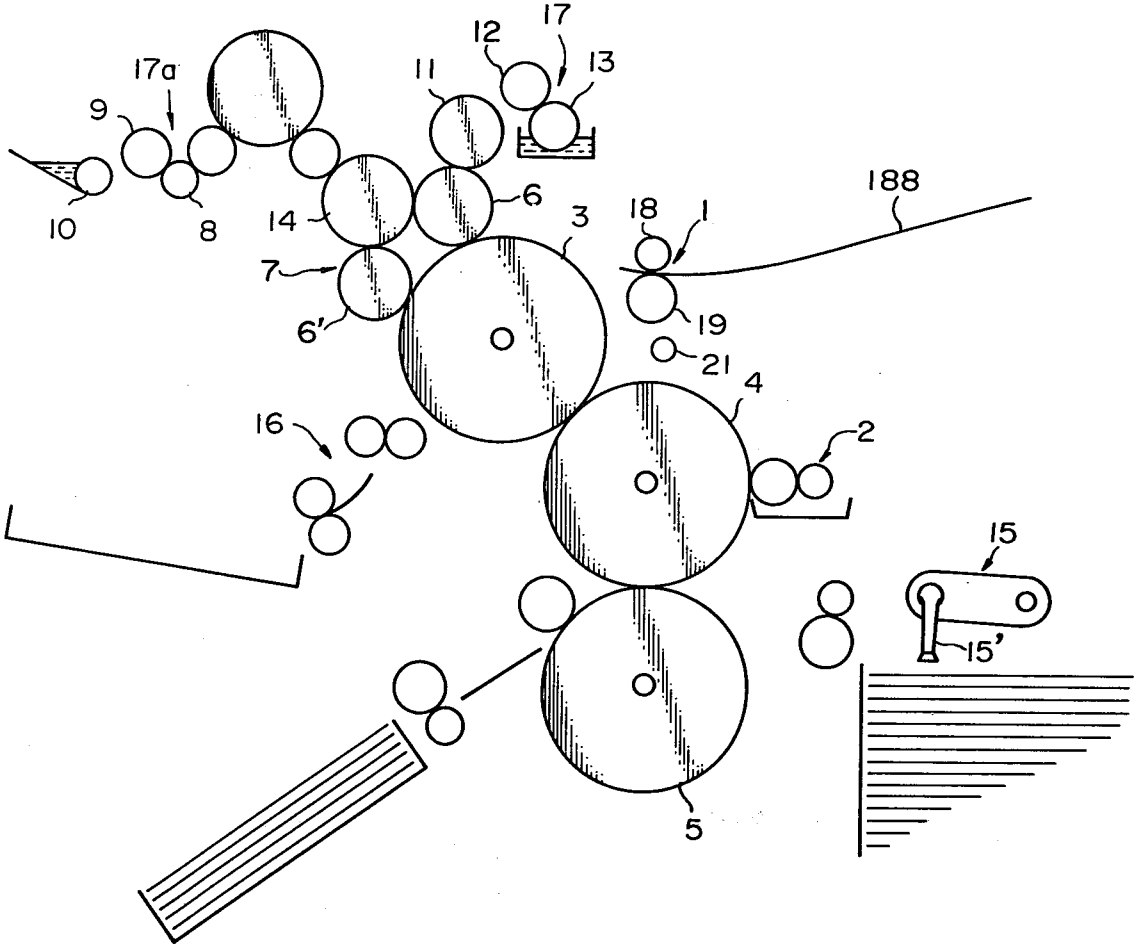
FIG. 1 is a schematic diagram showing the arrangement of a printing machine.

As shown in FIG. 1, a printing machine to which the invention is applied includes a plate loading device 1, a plate unloading device 16, a blanket cylinder cleaning device 2, a plate cylinder control mechanism, a sheet feed control mechanism, control mechanism for a water duct roller ("Duktor") and an ink duct roller ("Duktor"), and a form roller control mechanism 7.

Figure 2:
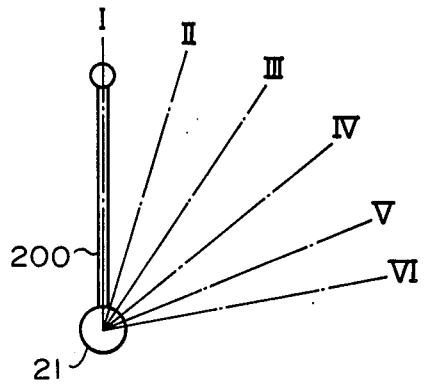
FIG. 2 is an explanatory diagram showing the operation of an operating lever according to the invention.

As shown in FIG. 2, an operating lever 200 fixedly secured to an operating shaft 21 is operated in six steps. Loading a plate, printing, unloading the plate and cleaning the blanket cylinder are carried out by operating the operating lever stepwise in a manner to be described.

Figure 3:
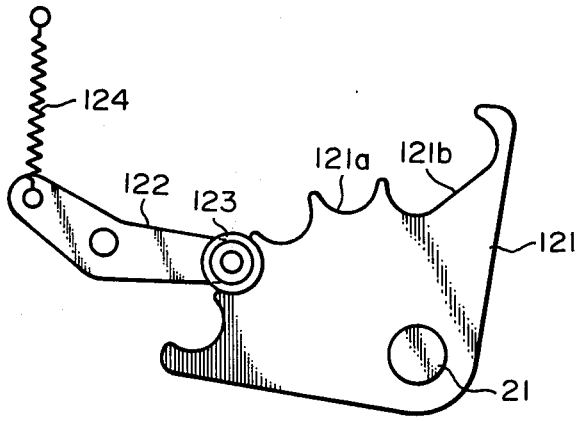
FIG. 3 is a front view of a mechanism for positioning the operating lever.

A mechanism for holding the operating lever 200 at each step is shown in FIG. 3. A set cam 121 is provided having five engaging recesses 121*a* and one cam recess 121*b*. The engaging recesses 121*a* define four of the positions (I–IV in FIG. 2) of the operating lever 200, while the cam recess 121*b* defines the other two positions (V–VI in FIG. 2). An arm 122 at one end of which an engaging roller 123 is rotatably provided is pivotally mounted on a frame or the like. The engaging roller 123 elastically abuts against the engaging recess by a spring 124. As the operating lever 200, and hence the operating shaft 21 is turned, the engaging roller 123 is engaged with the engaging recesses 121*a* one after another. The recesses hold the operating lever 200 at desired change-over positions. The operating lever 200 and the operating shaft 21 are returned automatically upon being released from a position VI (FIG. 2) to a position V (FIG. 2) by means of the cam recess 121*b* since both of these positions are accommodated by the cam recess 121*b*.

Figure 4:
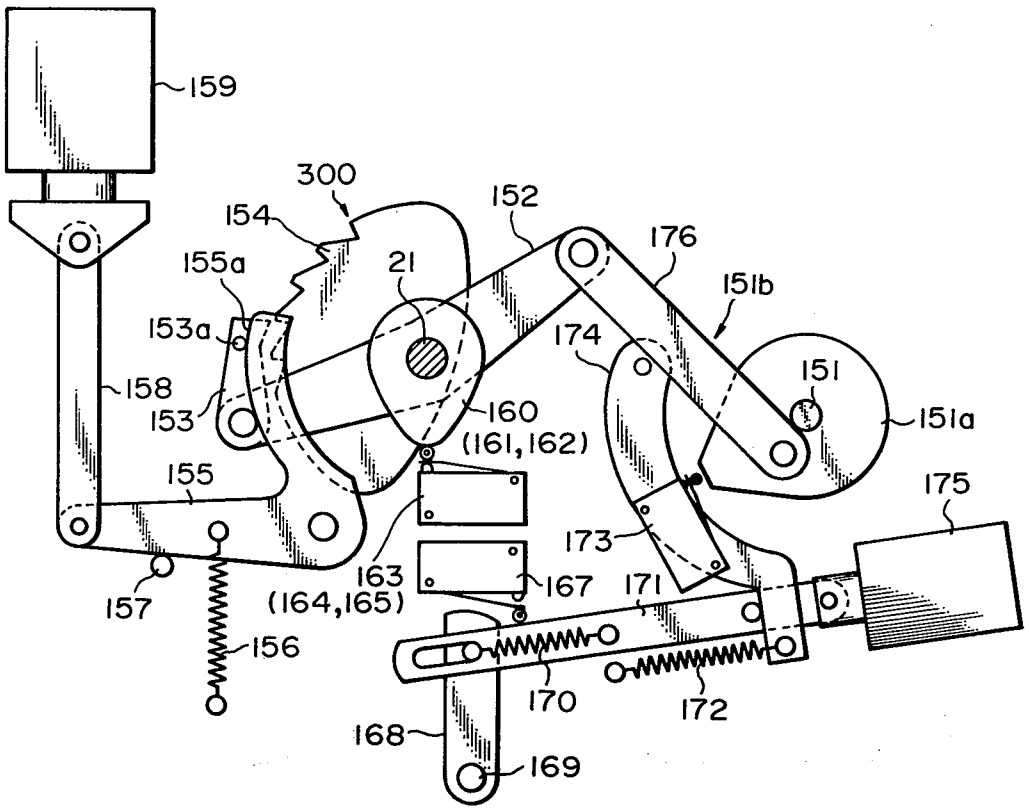
FIG. 4 is a side view of a plate loading mechanism with an operating lever automatic returning mechanism.

The operating lever 200 initiates the processes of loading a plate, etc. by the stepping change-over operation. After the printing operation is complete, the operating lever 200 is returned automatically in the opposite direction by an automatic return mechanism 300. In the automatic return mechanism 300, as shown in FIG. 4, an arm 152 is rocked through a link 176 by a crank mechanism 151*b* coupled to a rubber cylinder shaft 151. A pawl 153 having a pin 153*a* is pivotally coupled to the end portion of the arm 152. The pawl 153 is reciprocated as the arm 152 is rocked as described above. In the preliminary processes before the printing process, the pin 153*a* is rocked while being pushed upwardly by the end portion 155*a* of the cam 155. The cam 155 is abutted against a stop 157 by the elastic force of a spring 156 so that the pin 153*a* is maintained pushed upwardly. Under this condition, the pawl is not engaged with a ratchet 154 which is fixedly secured to the operating shaft 21. However, when for instance a counter which carries out a subtraction operation by counting printed sheets provides a signal representative of the completion of a printing operation, a solenoid 159 is operated to turn the cam 155 through a link 158 as a result of which the pin 153*a* is moved downwardly to cause the pawl 153 to engage with the ratchet 154. Under the condition that the pawl 153 has been engaged with the ratchet 154, as the rubber cylinder shaft 151 rotates, the ratchet 154, and hence the operating shaft 21, is rotated to return the operating lever 200 stepwise.

Figure 5:
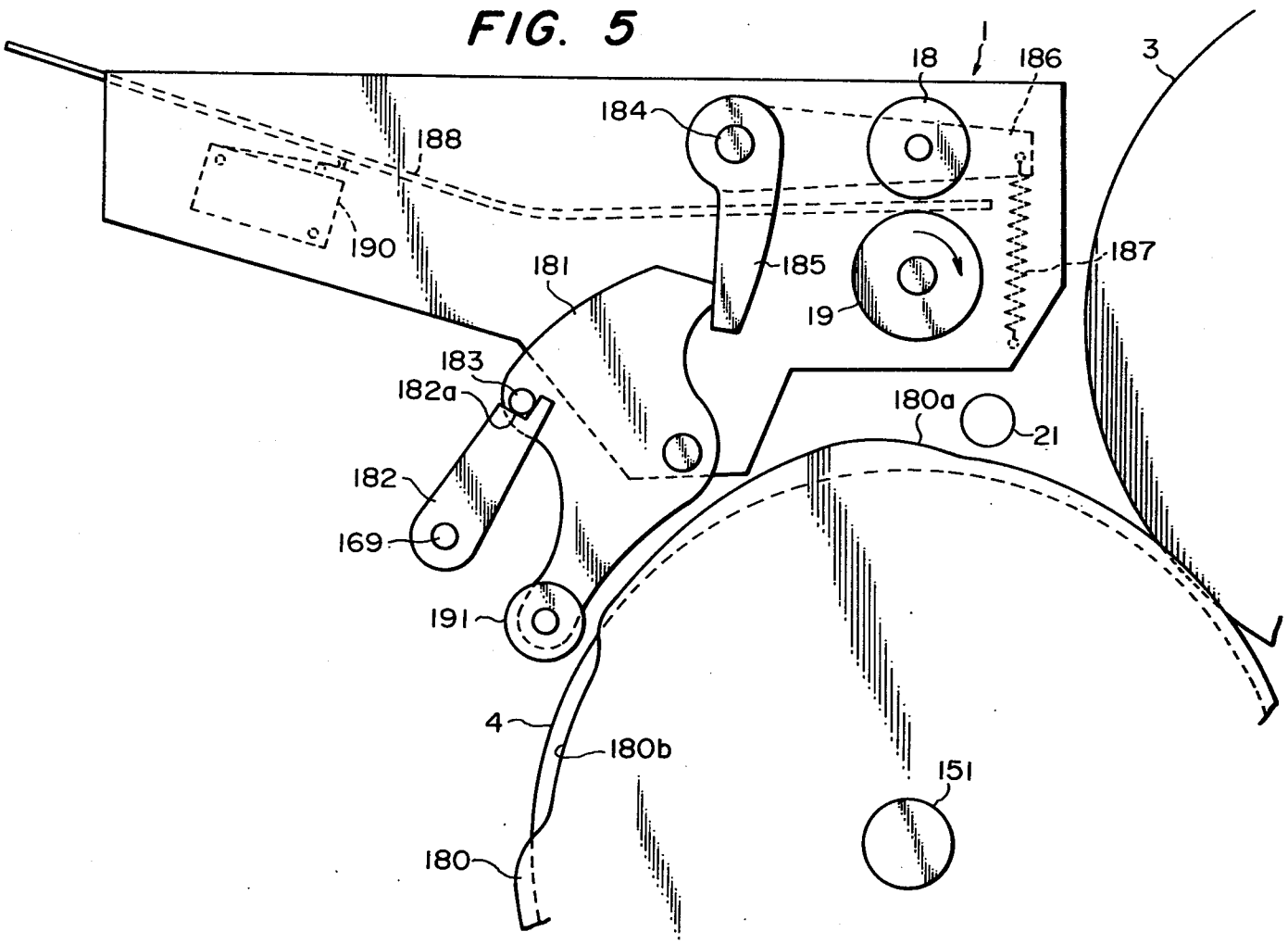
FIG. 5 is a side view of the plate loading mechanism in FIG. 4 as viewed from the opposite side.

In the plate loading device 1 as shown in FIGS. 4 and 5, cams 160, 161 and 162 are secured to the operating shaft 21, and switches 163, 164 and 165 are disposed to be operated by the cams 160, 161 and 162, respectively. The switches 163 and 164 operate to energize a solenoid 175 to which a link 171 is coupled. The link 171 is constantly urged in a return direction by a spring 170. A lever 168 is coupled to the link 171 in such a manner that it is turned around a rod 169 when the solenoid 175 is energized wherein a switch 167 is operated by movement of the lever 168.

The lever 168 is operated as follows. When, after the solenoid 175 has been operated, the highest point 180*a* of a cam 180 secured to one side surface of the rubber cylinder 4 is abutted against a roller 191 pivotally mounted on a rotatable arm 181 to turn the arm 181, whereby the pin 183 of the arm 181 is disengaged from the engaging portion 182*a* of a latch 182 as the latch 182 is turned by the elastic force of the spring 170, the lever 168 becomes operable. When the low point 180*b* of the cam 180 reaches the roller 191, the arm 181 is allowed to turn and an arm 185 is then rocked around a rod 184. An arm 186 with a roller 18 is secured to the rod 184. The arms 185 and 186 are urged clockwise by a spring 187 so that the roller 18 is depressed against a roller 19 which is rotated by a drive motor (not shown) and a plate 188 held between the rollers 18 and 19 is loaded onto the plate cylinder 3.

The plate cylinder 3 has a plate gripping part and a gripper end part (not shown). When the plate 188 has been loaded onto the plate cylinder 3, a switch 173 is closed by the cam 151*a* secured to the rubber cylinder shaft 151. The switch 173 is fixedly fastened to a lever 174 which is turned upon operation of the solenoid 175 and is returned by a spring 172. At the same time the switch 173 is closed, the solenoid 175 is deenergized and then the lever 174 is returned so that the switch 173 is opened. On the other hand, when the roller 191 is brought into contact with the cam 180, the latch 182 is engaged with the pin 183 as a result of which the roller 18 is moved away from the roller 19 to stop the plate loading operation. In this connection, when the switch 167 is closed by operation of the solenoid 175, a switch for a solenoid 226 (FIG. 6) adapted to operate the plate gripping part of the plate cylinder is operated. When the solenoid 175 is energized, the switch 173 is operated by being abutted against the cam 151*a*. However, as the switch 173 is not related to the operation of the plate loading device 1, it is operated in association with the solenoid 175 in order to lengthen the service life thereof.

The relations between the operations of the switches 163, 164 and 165 and the change-over positions of the operating lever 200 are as indicated below:

| | Operating Lever Position | | | | | |
|---|---|---|---|---|---|---|
| | I | II | III | IV | V | VI |
| Switch 163 | OFF | ON | ON | ON | ON | ON |
| Switch 164 | OFF | OFF | ON | ON | ON | ON |
| Switch 165 | OFF | ON | OFF | OFF | OFF | OFF |

With respect to the operating lever change-over positions, the circuit of the plate loading device 1 will be described with reference to FIG. 6. The circuit of FIG. 6 includes first through ninth relays R1–R9, a timer T1 and first and second motors 171, 172. The first motor M1 is an operating motor of the printing machine and the second motor M2 is a sheet feeding pump motor. The circuit further includes an automatic-manual change-over switch SS1, SS2 and first through fifth switches 163, 164, 165, 167 and 173. The third relay R3 has a normally open contact 201 coupled in series with a first motor M1 between first and second power source terminals. The first relay R1 has a normally open contact 212 coupled in series with the second motor M2 between the first and second power source terminals. The automatic-manual change-over switch SS1, SS2 has first SS1 and second SS2 switch sections, each of which has an armature contact and manual and automatic pole contacts. The armature contact of the first switch section SS1 is coupled to the first terminal of the power source. The first relay R1 has a coil R1 coupled between the manual pole contact of the first switch section SS1 and the second power source terminal and through a normally open contact 229 of the ninth relay R9 to the automatic pole contact of the first switch section SS1. The fourth relay R4 has a first normally open contact 202 coupled between the first power source terminal and the automatic pole terminal of the second switch section SS2. The eighth relay R8 has a first normally open contact 221 coupled between the automatic pole terminal of the first switch section SS1 and the automatic pole terminal of said second switch section SS2. The third relay R3 has a coil R3 coupled between the armature contact of the second switch section and the second power source terminal. The manual pole terminal of the second switch section SS2 is coupled to the first power source terminal. The eighth relay R8 has a second normally open contact 214 having one pole coupled to the armature contact of the second switch section. The timer T1 has a first switch section T1-224 having a first pole coupled to the armature contact of the second switch section SS2. The third switch 165 has first and second sections, each having a first pole coupled to a second pole of the eighth relay R8. A second pole of the first section of said third switch 165 is coupled to a second pole of the first section of the timer T1 and to a first terminal of the first solenoid 159. A second terminal of the first solenoid 159 is coupled to the second power source terminal. An operating coil of the timer T1 has a first terminal coupled to a second pole of the second section of the third switch 165 and a second terminal coupled to the second power source terminal. The sixth relay R6 has a normally open contact 220 having one pole coupled to the second pole of the second section of the third switch and a second pole coupled to a first terminal of a plate unloading solenoid 218. The plate unloading solenoid 218 has a second terminal coupled to the second power source terminal. A first terminal of a blanket cylinder cleaning solenoid 217 is coupled to the second pole of the second section of the third switch, and a second terminal of the blanket cylinder cleaning solenoid 217 is coupled to the second power source terminal. The second switch 164 has a first pole coupled to the first power source terminal and a second pole coupled to a first terminal of a coil of the ninth relay R9. A second terminal of the coil of the ninth relay R9 is coupled to the second power source terminal. The first switch 163 has a first pole coupled to the first power source terminal and a second pole coupled to a first terminal of a coil of the fourth relay R4. A second terminal of the coil of the fourth relay R4 is coupled to the second power source terminal. The timer T1 has a second switch section T1-225 having a first pole coupled to the first terminal of the power source. The fourth relay R4 has a second normally open contact 203 having a first pole coupled to a second pole of the second section T1-225 of the timer and a second pole coupled to a first pole of a normally open contact 228 of the ninth relay R9. A sixth switch 290 has a position determined by a type of the loading plate 188 being loaded and unloaded. The sixth switch 190 has a first section having a first pole coupled to a second pole of the normally open contact 228 of the ninth relay R9 and a second pole coupled to a first pole of a first normally closed contact 205 of the sixth relay R6. A second pole of the first normally closed contact of the sixth relay is coupled to a first terminal of the second solenoid 175. A second terminal of the second solenoid 175 is coupled to the second power source terminal. The fourth switch 167 has a first pole coupled to the second pole of the normally open contact 228 of the ninth relay R9 and a second pole coupled to a first terminal of a coil of said fifth relay R5. A second terminal of the coil of the fifth relay is coupled to the second power source terminal. The sixth relay R6 has a second normally closed contact 204 having a first pole coupled to the second pole of the fourth switch 167 and a second pole coupled to a first terminal of a solenoid adapted to operate a plate gripping member. A second terminal of the solenoid 226 is adapted to operate the plate gripping member coupled to the second terminal of the power source. The fifth relay R5 has a normally open contact 227 having a first pole coupled to the second pole of the normally open contact 228 of the ninth relay R9 and a second pole coupled to a first pole of the fifth switch 173. The fifth switch has a second pole coupled to a first terminal of a coil of the sixth relay R6. A second terminal of the coil of the sixth relay R6 is coupled to the second power source terminal. The sixth relay R6 has a first normally open contact 206 having a first pole coupled to the first pole of the fifth switch 173 and a second pole coupled to the second pole of the fifth switch 173. A second section of the sixth switch 190 has a first pole coupled to the second pole of the normally open contact 228 of the ninth relay R9 and a second pole coupled to a first pole of a second normally open contact 209 of the fixth relay R6. A second pole of the second normally contact 209 of the sixth relay R6 is coupled to a first terminal of a coil of the seventh relay R7. A second terminal of the coil of the seventh relay R7 is coupled to the second power source terminal. A first normally open contact 211 of the seventh relay R7 has a first pole coupled to the first pole of the second normally open contact 203 of said fourth relay R4 and a second pole coupled to the second pole of the normally open contact 228 of the ninth relay R9. The seventh relay R7 has a second normally open contact 210 having a first pole coupled to the second pole of the normally open contact 228 of the ninth relay R9 and a second pole coupled to the second pole of the second normally open contact 209 of said sixth relay R6. The timer T1 has a switch 213 adapted to be closed after a predetermined number of sheets has been counted, the switch 213 of the timer T1 having a first pole coupled to the second pole of the normally open contact 228 of the ninth relay R9 and a second pole coupled to a first terminal of a coil of the eighth relay R8. A second terminal of the coil of the eighth relay is coupled to the second power source terminal, and the eighth relay has a normally open contact R8 having a first pole coupled to the second pole of the normally open contact 228 of the ninth relay R9 and a second pole coupled to the second pole of the switch 213 of the timer T1.

The operation of the circuit of FIG. 6 will now be explained. When the operating lever 200 is set at the position II, the switch 163 is closed energizing a relay R4 closing normally open contacts 202, 203 thereof, and accordingly, a relay R3 is energized through an automatic-manual change-over switch SS1, SS2. As a result, the normally open contact 201 of the relay R3 is closed actuating a motor M1 of the device. When the operating lever 200 is set at the position III, the switch 164 is closed energizing a relay R9 and closing a normally open contact 228 thereof. Thus, the plate loading circuit is enabled through a normally open contact 203 of the relay R4.

The plate loading circuit has a switch 190 the position of which is determined according to the type of original plate employed, such as a master plate or a PS plate. A plate for which the switch 190 is closed is manually loaded onto the plate cylinder. Assuming that a plate for which the switch 190 should be closed is employed, when the normally open contacts 203 and 228 are closed, the solenoid 175 is energized since a contact 205 of the relay 6 is normally closed. As a result, as described above, the switch 167 is closed to energize a relay R5 and simultaneously to energize the solenoid (not shown) of the plate gripping part, whereby the plate is loaded onto the plate cylinder. When the solenoid 175 is energized as described above, the switch 173 is then closed by the cam **151*a* to energize a relay R6**.

When the relay R6 is energized, its normally closed contacts 204 and 205 are opened deenergizing the solenoid 175. The normally open contacts 206 and 227 serve as storing or memory circuits for storing the closures of the switches 167 and 173. When, after the plate has been loaded onto the plate cylinder, the switch 190 is disengaged from the plate, the contact 207 of the switch 190 is closed. When the contact 207 of the switch 190 is closed with a contact 209 of the relay R6 closed, a relay R7 is energized closing normally open contacts 210 and 211 while the states of the normally open contact 203, the normally open contact 228, the normally closed contact 207 of the switch 190 and a normally open contact 209 are held so that the loading of the plate is stored. Thus, even if the machine is stopped by returning the operating lever to the position I during automatic operation, the loading of the plate is maintained stored irrespective of the states (open or closed) of the normally open contacts 203 and 228. When loading a plate is not accomplished properly, the plate is brought into contact with the switch 190, i.e. the switch 190 is not closed. Therefore, in this case, it is necessary to return the operating lever to the position I or II again and then to set it to the position III to carry out the plate loading operation.

When the operating lever is at the position III, a relay R1 is energized through a normally open contact 229 of the relay R9 which is energized by the switch 164 as a result of which a sheet feeding pump motor M2 (described below) is actuated. However, if the operating lever is at the position I or II, the switch 164 is in the "off" state, and therefore the pump motor M2 is not operated.

When the number of sheets printed reaches a predetermined value, a counter adapted to count printed sheets outputs a signal to close a normally open contact 213. As a result, a relay R8 is energized closing a normally open contact 214 so that the solenoid 159 is energized through a normally closed contact 215 of the switch 165 and the operating lever returning mechansim 300 is operated. When the operating lever is returned to the position II, the switch 165 is closed opening its contact 215 and thereby deenergizing the solenoid 159 as a result of which operation of the returning mechanism 300 is stopped. At the same time, a normally open contact 216 of the switch 165 is closed energizing a blanket cylinder cleaning solenoid 217 to clean the rubber cylinder 4. Furthermore, in this operation, a plate unloading solenoid 218 is operated to unload the plate from the plate cylinder 3.

Figure 6:
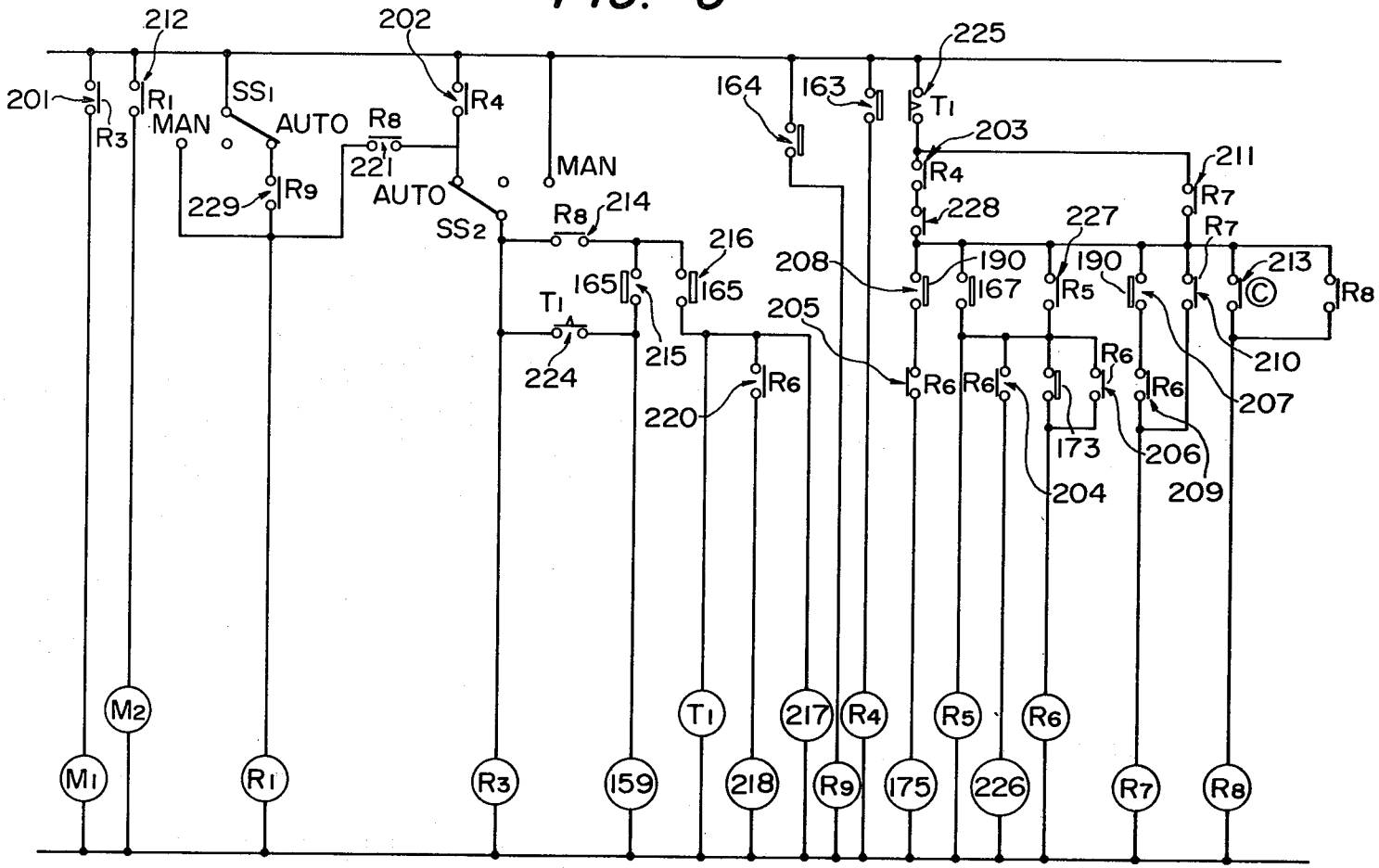
FIG. 6 is a circuit diagram showing the electrical circuit of the plate loading mechanism.

In FIG. 6, a normally open contact 220 of the relay R6 is connected in a security circuit which inhibits the energization of the plate unloading solenoid 218 when no plate is loaded onto the plate cylinder.

When a predetermined period of time has passed since the closure of the contact 216, a normally-open timer contact 224 is closed by a timer T1 energizing the solenoid 159 as a result of which the operating lever returning mechanism 300 is operated again to return the operating lever to the position I from the position II. At the same time, a normally-closed timer contact 225 is opened deenergizing the relays R5, R6 and R7, whereby the stored indication of the loading of the plate is eliminated. When the operating lever is returned to the position I, the motors M1 and M2 are stopped. At that point, all operations have been accomplished.

After the plate 188 has been loaded onto the plate cylinder 3, the surface of the plate on the plate cylinder is coated with a moisture supplying solution and ink after which the printing process is carried out. This coating process is carried out merely by operating (changing the position of) the operating lever.

Figure 7:
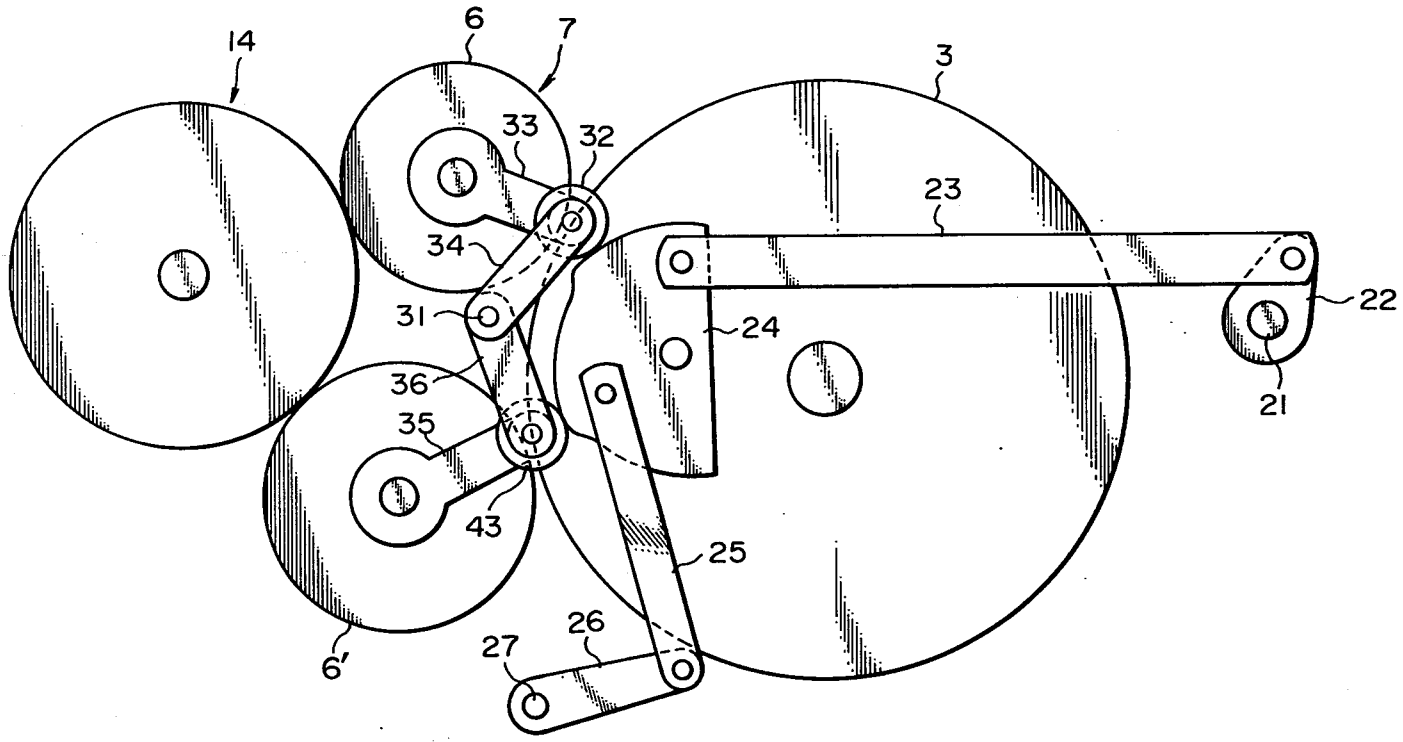
FIGS. 7 and 8 are side views of a form roller control mechanism.
Figure 8:
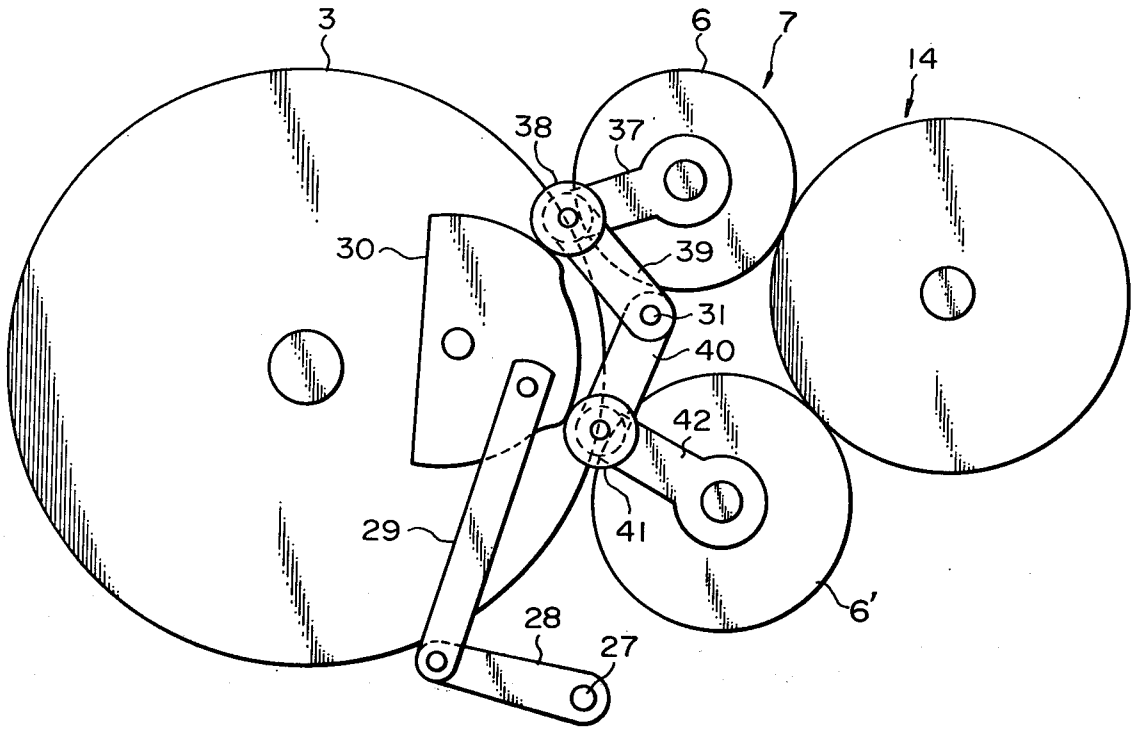

The form rollers 6 and 6' are set in such a manner that they are in contact with the plate cylinder 3 before the plate loading operation. A control mechanism 7 for the form rollers 6 and 6' adapted to coat the plate surface with the moisture supplying solution and ink is as shown in FIGS. 7 and 8. An arm 22 is fixedly secured to the above-described operating shaft 21 and a cam 24 is coupled through a link 23 to the arm 22 so that the cam 24 is turned as the position of the operating lever is changed. Rollers 32 and 43 with arms 34 and 36, which is rotatably coupled to each other at 31, are abutted against the cam 24. The form rollers 6 and 6' are pivotally mounted on the arms 34 and 36 through arms 33 and 35, respectively. The cam 24 is pivotally coupled through a link 25, an arm 26 and a rod 27 to an arm 28 (FIG. 8) on the opposite side of the plate cylinder. The arm 28 is pivotally coupled through a link 29 to a cam 30 which is similar to the cam 24. Similarly as for the cam 24, rollers 38 and 41 having arms 39 and 40 which are pivotally coupled to each other at 31 are abutted against the cam 30. The form rollers 6 and 6' are pivotally mounted on the arms 39 and 40 through arms 37 and 42, respectively. Since the rollers 32 and 43 and the rollers 38 and 41 are abutted against the cams 24 and 30 respectively as described above, as the cams 24 and 30 are turned, the form rollers 6 and 6' are brought into contact with the plate cylinder 3. Then, after a plate is loaded onto the plate cylinder, the form rollers are brought into contact with the surface of the plate under pressure and are later moved away from the plate surface after completion of a printing operation. The moisture supplying solution and the ink are transferred to the form rollers 6 and 6' through duct rollers 12 and 9 and distribution rollers 11 and 8 from fountain rollers 13 and 10 immersed in a moisture supplying solution tank and an ink tank. When the operating lever is at the position III, the form rollers 6 and 6' are brought immediately into contact with the plate cylinder 3 after which the plate is loaded onto the plate cylinder 3. Thereafter, the form rollers are depressed against the surface of the plate.

Figure 9:
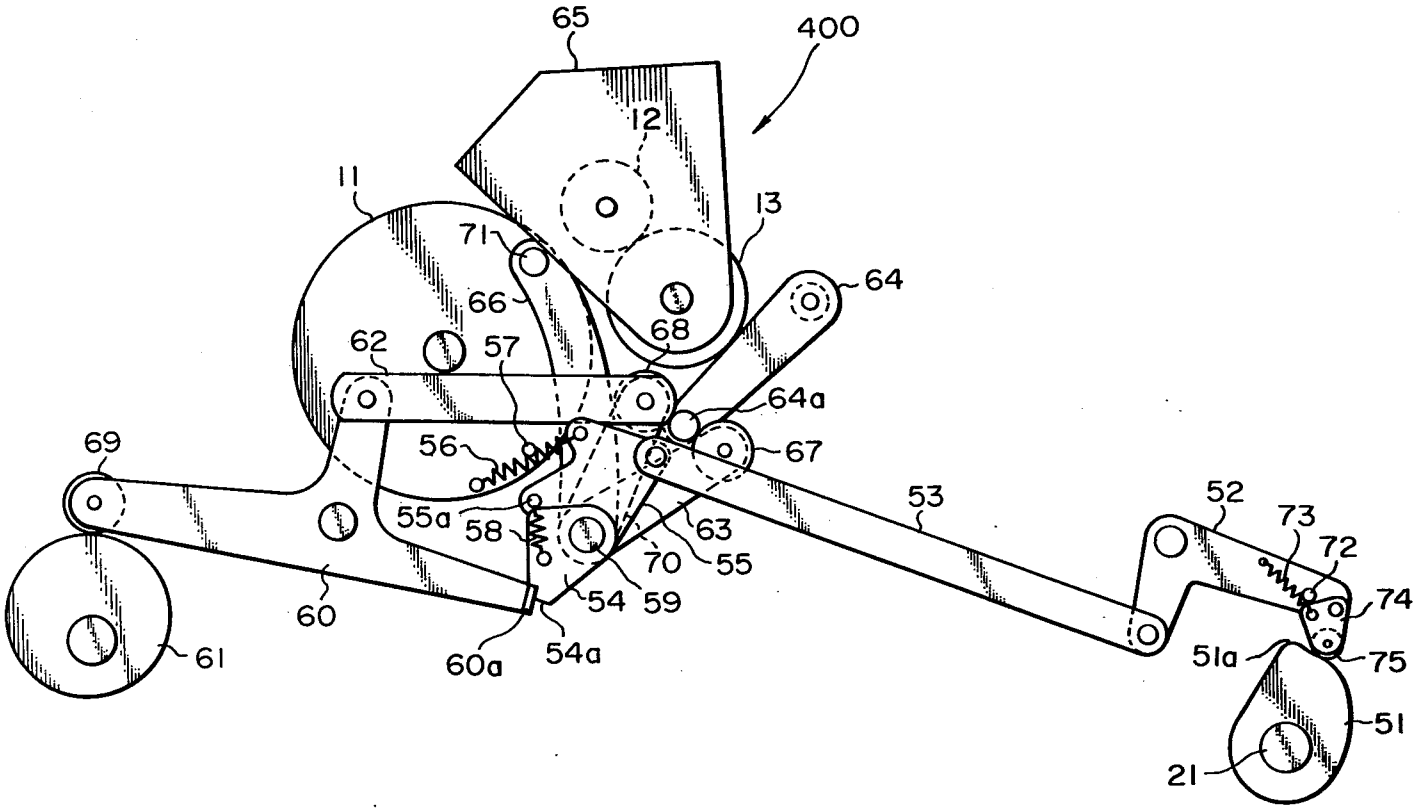
FIG. 9 is a side view of a water duct roller control mechanism.

The water duct roller control mechanism 400 is shown in FIG. 9. As a cam 51 is turned, a lever 52 is operated through a sub-lever 74. A lever 55 pivotally mounted on a shaft 59 is rotatably coupled through a link 53 to the cam lever 52. A latch 54 is loosely fitted on the shaft 59, and a spring 58 is connected between the latch 54 and the lever 55 so that, as the lever 55 is turned, the latch 54 is also turned. An engaging portion 60*a* of a rotatable lever 60 is freely movable into and out of engagement with an engaging portion 54*a* of the latch 54. Engagement and disengagement are carried out by a cam 61 which has a different rotation ratio from the plate cylinder 3. More specifically, the roller 69 of the lever 60 is abutted against the cam 61, and therefore as the cam 61 is turned, the lever 61 is turned to carry out engagement and disengagement. The lever 60 is coupled through a link 62 to an arm 70 fixed to the shaft 59 with the arm 70 having a roller 68. An arm 63 is fixedly secured to the shaft 59 at one end thereof with a roller 67 provided at the other end. A pin 64*a* of an arm 64 is interposed between the rollers 67 and 68 in such a manner that it can be freely displaced. By controlling the displacement of the arm 64, the relative angle between the arms 63 and 70 is varied thereby varying the rocking position of an arm 66 described below.

The arm 66 is fixedly secured to the shaft 59 at one end and has a pin 71 at the other end. The pin 71 is engaged with a frame 65 holding the fountain roller 13 and the duct roller 12. As the cam 61 is rotated, the lever 60 is turned to rock the arm 66 thereby to cause the duct roller 12 to contact the distribution roller 11 as a result of which a suitable quantity of water is supplied to the distribution roller. By displacing the arm 64, the rocking position of the arm 66 is controlled thereby to adjust the period of time during which the duct roller 12 is in contact with the distribution roller 11. FIG. 9 shows the water duct roller mechanism in a stopped state.

The cam 51 has a protrusion 51*a*. When the operating lever 200 is turned to the position II, the sub-lever 74 is turned counterclockwise by the protrusion 51*a* and a roller 75 coupled to the sub-lever 74 and the lever 55 is caused to strike against a stop 57. In this manner, the water duct roller is operated.

If the operating lever is further turned to the position where the roller 75 of the sub-lever 74 is not affected by the cam 51 at all, the sub-lever 74 is turned clockwise until it abuts against the stop 72. When the operating lever is returned to the position II after completion of the printing operation, the lever 52 is turned counterclockwise through the sub-lever 74 by the cam 51. Thus, the operation of the water duct roller mechanism is stopped.

Figure 10:
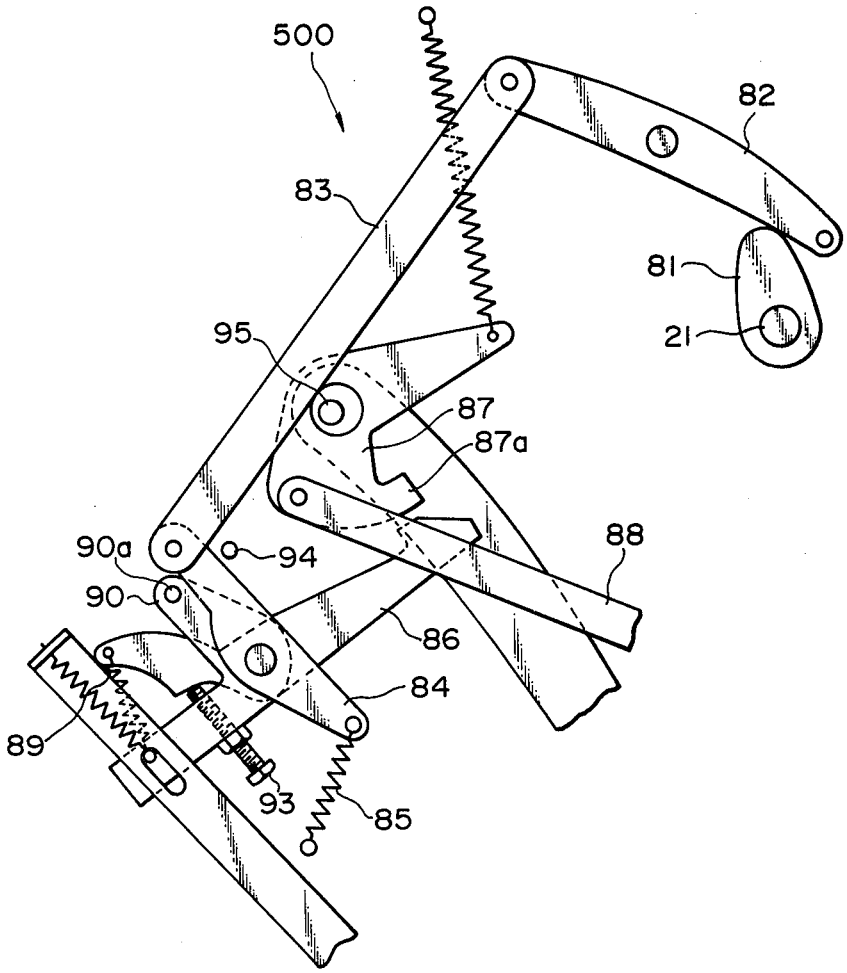
FIG. 10 is a side view of a plate cylinder control mechanism.

In the plate cylinder control mechanism 500, as shown in FIG. 10, a cam 81 is fixedly secured to the above-described operating shaft 21, a rotatable cam lever 82 is abutted against the cam 81, and a rotatable lever 84 is coupled through a link 83 to the cam lever 82. The lever 84 is urged counterclockwise by a spring 85 at all times. The lever 84 is engageable with a pin 90*a* of a lever 90 and a spring 89 is connected between the lever 90 and a rotatable latch 86. When the levers 84 and 90 are turned by turning the operating shaft 21, the latch 86 is also turned through the spring 89 so that the latch 86 engages the engaging portion 87*a* of a lever 87 in a rocking state. As a result, since the lever 87 is fixedly mounted on the plate cylinder shaft 95, the plate cylinder 3 is maintained abutted against the rubber cylinder 4. This forcible contact is carried out when the pattern on the plate is transferred onto the rubber cylinder. When the lever 84 is turned to contact a stop 94 by rotation of the cam 81, the latch 86 is disengaged from the lever 87 so that the forcible contact is released. A link 88 is operated in association with a plate cylinder detachably mounting device (not shown) to turn the lever 87.

Figure 11:
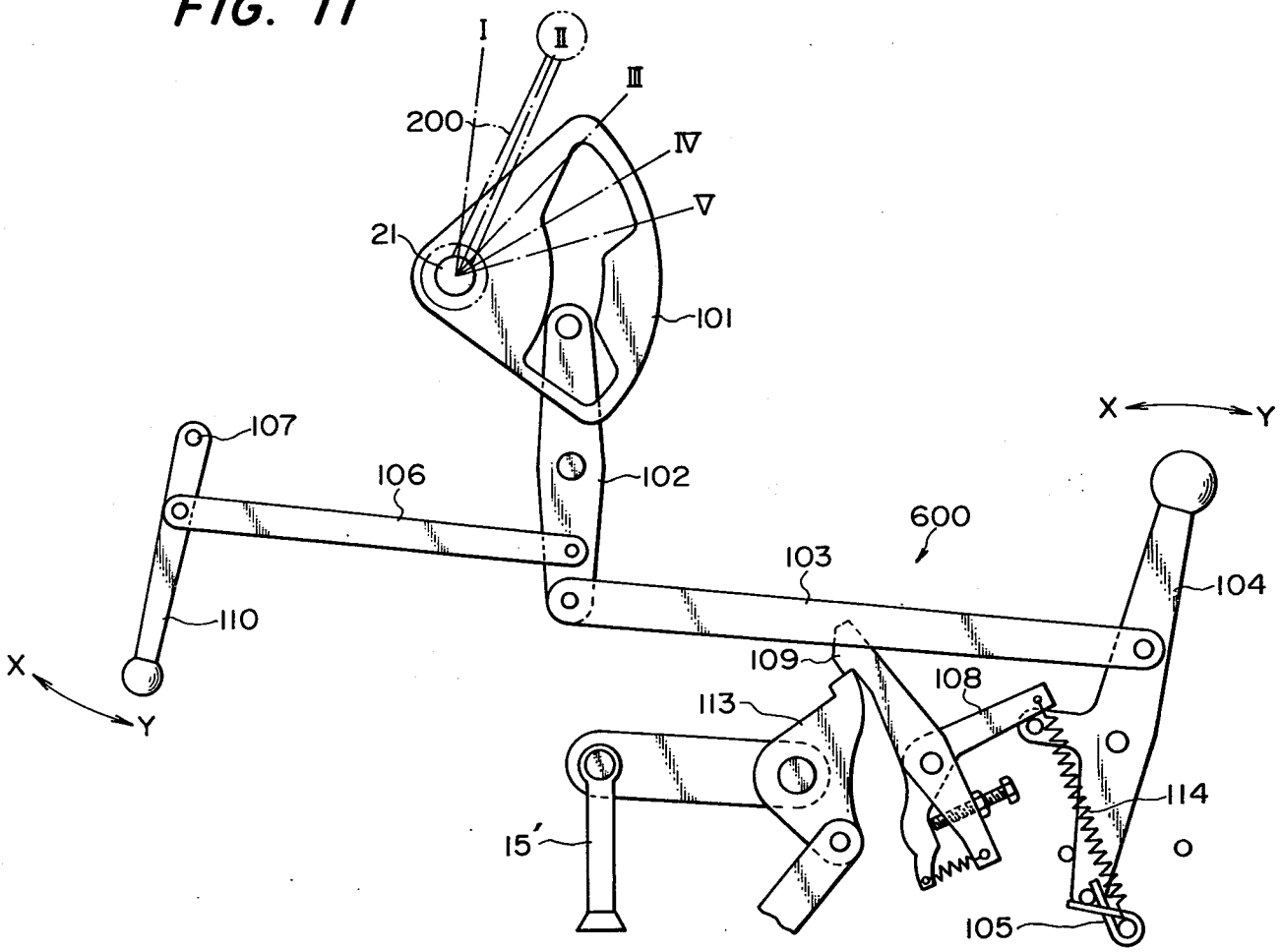
FIG. 11 is a side view of a sheet feed control mechanism.

In the sheet feed control mechanism 600, as shown in FIG. 11, a control cam 101 is fixedly secured to the operating shaft 21 and an arm 102 is engaged with the control cam 101 so that the arm 102 is turned upon rotation of the operating shaft 21. An auxiliary operating lever 104 is rotatably coupled through a link 103 to the arm 102. The auxiliary operating lever 104 is engaged with an arm 108 with which a latch 109 is engaged. As the latch 109 is turned, it is engaged with or disengaged from a lever 113. When the latch 109 is engaged with the lever 113, a suction foot 15' is not operated so that no sheet is fed. That is, when the auxiliary operating lever is turned in the direction Y, the sheet feeding operation is not carried out. The relations between the positions of the operating lever 200 and the operations of the auxiliary operating lever 104 are as indicated in the following table:

| Operating lever 200 position | Auxiliary operating lever 104 operation |
|---|---|
| I | Movable in the directions X and Y (neutral) |
| II | Movable in the directions X and Y (neutral) |
| III | Turn in the direction Y |
| IV | Turn in the direction Y |
| V | Movable in the directions X and Y |
| VI | Turn in the direction X |

Figure 12:
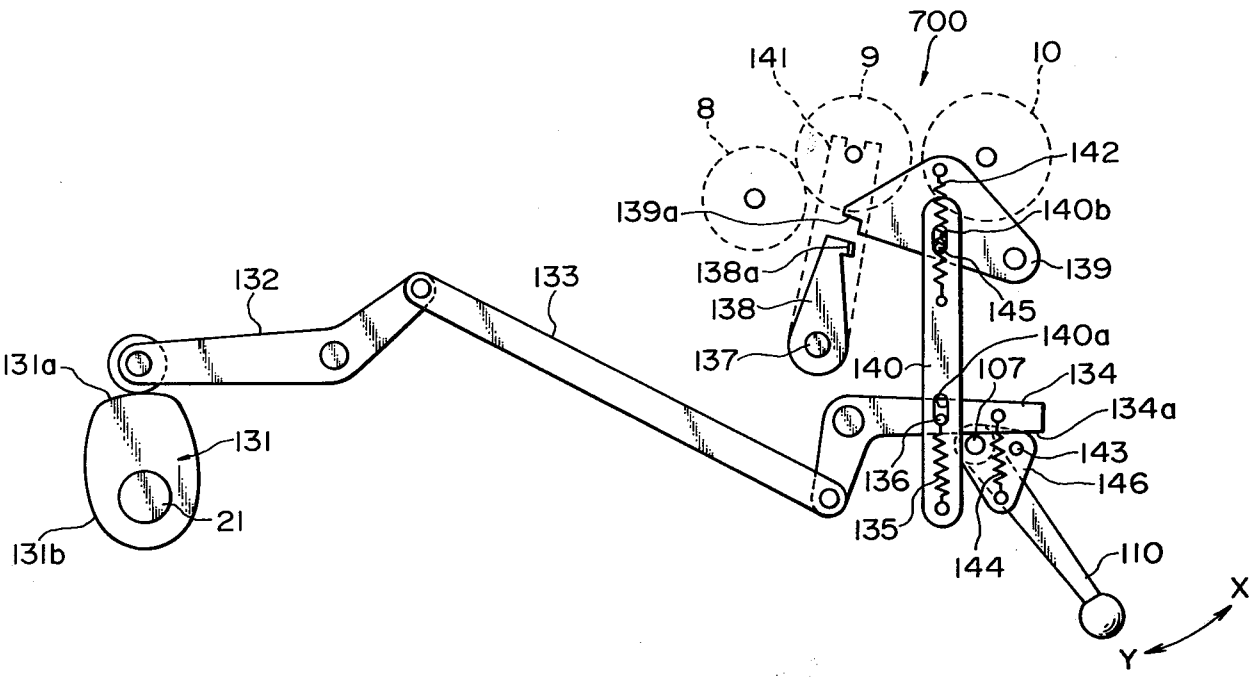
FIG. 12 is a side view of an ink duct roller control mechanism.

The ink duct roller control mechanism 700 is constructed as shown in FIG. 12. A cam 131 fixedly secured to the operating shaft 21 is turned by the operating lever 200 whereby a latch 139 is turned clockwise through a cam lever 132, a link 133, a bell arm 134 and a link 140. The ink duct roller 9 is swung between the roller 8 and the fountain roller 10 in such a manner as to be brought into and out of contact therewith to supply ink. Arms 141 and 138 are fixedly mounted on a shaft 137. At the low position 131*b* of the cam 131, the latch 139 is turned counterclockwise, and the ink duct roller 9 is brought into contact with the roller 8. At that time, the engaging portion 138*a* of the arm 138 is engaged with the engaging portion 139*a* of the latch 139 to stop the swinging of the roller 9 so that the roller 9 is maintained in contact with the roller 8. Thus, the function of the ink duct roller control mechanism is stopped. On the other hand, at the high position 131*a* of the cam 131, the latch 139 is turned clockwise so that the latch 139 is disengaged from the arm 138 to start the ink supplying operation. The ink duct roller control mechanism 700 is so designed that it is operated before the form rollers 6 and 6' contact the surface of a plate.

The above-described lever 102 (FIG. 11) is coupled through a link 106 to a lever 110 which is fixedly secured to a shaft 107. With this structure, if the lever 110 is turned in the direction X, the sheet feeding operation is effected (ON). However, if the lever 110 is turned in the direction Y, the sheet feeding operation is suspended (OFF). The link 140 is operated through a spring 135 by a pin 136 attached to the bell arm 134. The link 140 has a relief hole 140*a* whose length corresponds to the amount of displacement of the pin 136.

The latch 139 is operated by a pin 145 attached thereto.

The link 140 has an elongated hole 140*b* used to operate the latch 139 with the aid of a spring 142. At the low position 131*b* of the cam 131, i.e. when the operating lever 200 is at the position I, II, V or VI, the arm 134 is operated wth its end portion 134*a* in contact with a pin 143 which is fixedly secured to a lever 146 which is fixedly mounted on a shaft 107. That is, when the lever 110 is turned in the direction X, the bell arm 134 is turned counterclockwise by the pin 143, the latch 139 is maintained disengaged from the arm 138 by a spring 135 and the link 140, whereby ink is supplied. When the lever 110 is turned in the direction Y, the bell arm 134 is turned clockwise, the latch 139 is engaged with the arm 138 through the link 140 and the spring 142, whereby the supply of ink is stopped.

At the high position of the cam 131, i.e. when the operating lever 200 is at the position III or IV, although the lever 110 is turned in the direction Y, the bell arm 134 is turned counterclockwise so that the latch 139 is maintained disengaged from the arm 138 whereby the supply of ink is effected.

Figure 13:
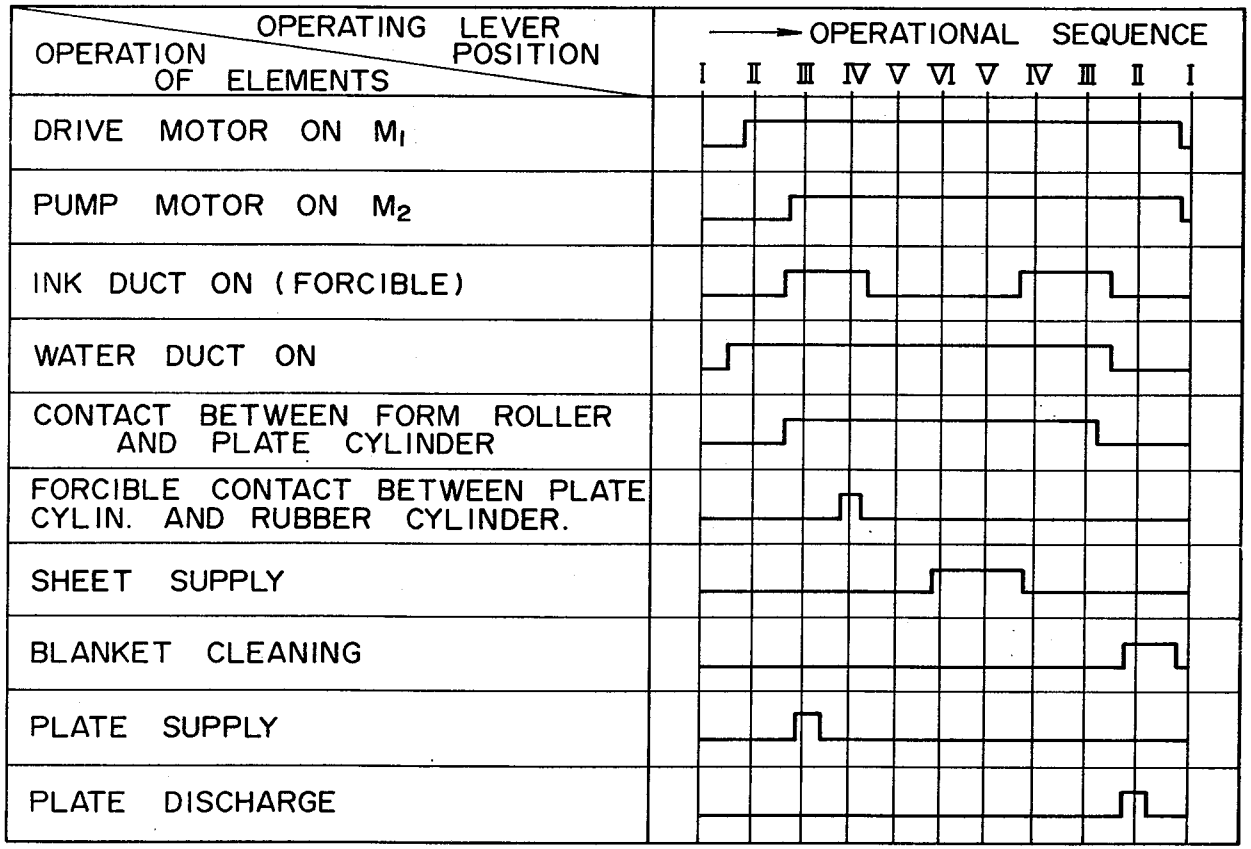
FIG. 13 is an explanatory diagram indicating relations between positions of the operating lever and operations of various elements.

When the operating lever 200 is at the position I, all mechanical operations are stopped as indicated in FIG. 13. When the operating lever 200 is shifted to the position II, the drive motor M1 is driven, and the water duct roller control mechanism 400 is operated. In this operation, the ink duct roller control mechanism 700 is maintained stopped because the sheet feeding operation is suspended. When the operating lever 200 is shifted to the position III from the position II, the ink duct roller control mechanism 700 is operated, the form roller control mechanism 7 is then operated causing the form rollers 6 and 6' to contact the plate cylinder 3, the plate loading device 1 is operated to load a plate onto the plate cylinder, and then the pump motor M2 is operated to prepare for feeding sheets. In addition, the form rollers are brought into contact with the surface of the plate for the inking operation. If loading the plate onto the plate cylinder fails, the operating lever 200 should be returned to the position I and then moved to the position III again in order to load the plate on the plate cylinder, as described above. Thereafter, the operating lever 200 is shifted to the position IV so that the plate cylinder 3 is forcibly brought into contact with the rubber cylinder for carrying out the transferring operation. When the operating lever 200 is moved through the position V to the position VI, the sheet feed control mechanism 600 is operated to feed sheets. If, in this operation, the operating lever 200 is released, immediately the operating lever 200 is returned to the position V and accordingly the printing operation is carried out. Upon completion of the printing operation, the operating lever 200 is returned by the operating lever (200) returning mechanism 300. When the operating lever 200 is returned to the position III, the form rollers 6 and 6' are moved away from the surface of the plate. When the operating lever 200 is returned to the position II, the blanket cylinder cleaning operation is carried out. In this case, the water duct roller is stopped. When the operating lever 200 is returned to the position I, all of the driving operations are stopped.

As is apparent from the above description, according to the invention, all the processes from the plate loading process to the transferring process onto the rubber cylinder can be carried out successively while the operator visually confirms that each process has been successively completed before the printing operation is carried out. Therefore, printing errors at the start of the printing operation are eliminated. As the form rollers are brought into contact with the plate cylinder by operating the form roller control mechanism before a plate is loaded onto the plate cylinder, the plate can be satisfactorily placed on the plate cylinder, and accordingly the printing operation can be carried out satisfactorily beginning with the first plate. Furthermore, even if no sheet has been fed when the form rollers contact the surface of a plate and the surface of the plate contacts the rubber cylinder, the ink duct roller control mechanism can be operated to supply ink. Therefore, even in the case where a number of original plates are used, the quantity of ink on the inking roller is maintained unchanged thereby providing for a uniform printing operation at all times. Although a manual operation is employed, it is carried out with one operating lever. Therefore, the operation is simple and can be performed even by an unskilled operator. As the operating lever is automatically returned to the original position after the printing operation has been completed, the various mechanisms such as the plate unloading mechanism and the blanket cylinder cleaning mechanism can be readily operated in association with the operating lever returning operation. Thus, all the processes are automatically reset without need of operator intervention.

What is claimed is:

1. A printing machine having an operating lever device, comprising:

a plate cylinder;
means for loading plates onto said plate cylinder;
means for unloading said plates;
a blanket cylinder;
means for cleaning said blanket cylinder;
form rollers;
a form roller control mechanism;
a plate cylinder control mechanism;
a sheet feed;
a sheet feed control mechanism;
a water duct roller;
a water duct roller control mechanism;

a rubber cylinder;
an ink duct roller;
an ink duct roller control mechanism;
an operating lever device;
said operating lever device comprising an operating lever adapted to be set at any of a plurality of positions stepwise and a set cam secured to an operating shaft which is fixedly secured to said operating lever, said set cam holding said operating lever in such a manner that said operating lever can be held at more than one of said plurality of positions;
a plurality of cams and arms coupled to said operating shaft for controlling said plate loading means, plate unloading means, blanket cylinder cleaning means, form roller control mechanism, plate cylinder control mechanism, sheet feed control mechanism, water duct roller control mechanism and ink duct roller control mechanism in accordance with an angular position of said operating lever;
said plate loading means comprising a switch mechanism having a memory circuit adapted to be set to open and closed positions in accordance with a plate loading operation and to store a plate loaded state during an additional plate loading operation which is carried out upon completion of a first plate loading operation;
an automatic returning mechanism for returning said operating lever to at least one of said plurality of positions, said automatic returning mechanism comprising at least one solenoid, said automatic returning mechanism being operated by said solenoid according to a rotational position of said rubber cylinder, said automatic returning mechanism being operatively coupled to said operating lever, said solenoid being coupled to be energized upon completion of a printing operation to successively return said operating lever to at least one of said plurality of positions;
at least said water duct roller control mechanism and said form roller control mechanism being operatively coupled to said operating lever to be operated before a plate loading operation of said plate loading means by setting said operating lever stepwise to cause said form rollers to contact said plate cylinder; and
said ink duct roller control mechanism being coupled to said operating shaft in such a manner that ink is supplied in a step in which said form rollers contact the surface of said plate and the surface of said plate contacts said rubber cylinder after said plate has been loaded on said plate cylinder.

2. The printing machine of claim 1 wherein said set cam of said operating lever device is fixedly secured to said operating shaft, said set cam having a plurality of engaging recesses and a cam recess larger than said engaging recesses formed therein; a lever pivotally mounted at a center position thereof, said lever having an engaging roller rotatably disposed at one end thereof positioned to engage said engaging recesses; and a spring for rotatably biasing said lever to urge said engaging roller into engagement with said engaging recesses.

3. The printing machine of claim 1 wherein said automatic returning mechanism comprises a first solenoid having a first link coupled thereto at one end, a rotatably mounted cam having one end coupled to said link; a ratchet fixedly mounted on said operating shaft, a second end of rotatably mounted cam being engagable with teeth of said ratchet; a second link having one end coupled in a crank manner to a shaft of said rubber cylinder; a first arm having one end coupled to a second end of said second link, said arm being rotatably mounted on said operating shaft; a pawl mounted on a second end of said arm, said pawl having a pin at an end thereof engagable with a surface of said cam opposite a portion engaging with said teeth of said rotatably mounted rachet.

4. The printing machine of claim 3 wherein said first solenoid is operatively coupled to a counter for counting printed sheets wherein said solenoid is operated to turn said rotatably mounted cam to engage said pin with said ratchet when said counter indicates the completion of a printing operation.

5. The printing machine of claim 3 wherein said plate loading means comprises first through third cams secured to said operating shaft; first through third switches operated by said first through third cams, respectively; a second solenoid; a third link slidably coupled to said second solenoid; a spring for urging said third link in a return direction; a first rod; a first lever fixedly coupled to said first rod at one end of said first lever, said first lever having a second pin rigidly coupled to a second end thereof, said second pin being slidably disposed in a slot in said third link, said spring for urging said third link in said return direction having one end coupled to said second pin rigidly coupled to said first lever; a latch rigidly coupled to said first rod; a rotatable second arm having a third pin rigidly coupled thereto positioned to be engaged with said latch, said second arm having a roller on one end thereof; a fourth cam coupled to rotate with said shaft of said rubber cylinder, said roller of said second arm following said fourth cam; a second rod and third and fourth arms rigidly mounted on said second rod for rotation therewith, one end of said third arm being disposed to abut an end of said second arm; a second spring for urging said third arm into abutment with said second arm; a second roller rotatably mounted on said fourth arm; a third roller disposed opposite said second roller and coupled to a drive motor for rotation, said second and third rollers transporting said plates therebetween; a second lever positioned to be moved by said second solenoid; a fifth cam rigidly coupled to said rubber cylinder shaft to rotate therewith; a fourth switch having an actuating member disposed to be actuated by said first lever and a fifth switch mounted on said second lever having an actuating member disposed to be actuated by said fifth cam.

6. The printing machine of claim 1 wherein said form roller control mechanism comprises a first arm rigidly coupled to be rotated with said operating shaft; first and second similar cams disposed adjacent opposite ends of a plate cylinder; a first link coupled between one end of said first arm and said first cam; a second arm pivotally mounted to a first end of a first form roller; a third arm pivotally mounted to a first end of a second form roller; first and second additional rollers coupled to ends of said second and third arms, respectively and disposed to abut said first cam; a fourth arm having one end rotatably coupled to said end of said second arm; a fifth arm having one end rotatably coupled to said end of said third arm, said fourth and fifth arms having second ends rotatably coupled together; a second link rotatably coupled to one end to said first cam; a sixth arm having one end rotatably coupled to a second end of said second link; a rod, said sixth arm having a second end rigidly coupled to said rod; a seventh arm having a first end rigidly coupled to said rod; a third link having one end rotatably coupled to a second end of said seventh arm and a second end rotatably coupled to said second cam; an eighth arm pivotally mounted to a second end of said first form roller; a ninth arm pivotally mounted to a second end of said second form roller; third and fourth rollers coupled to ends of said eighth and ninth arms, respectively, and disposed to abut said second cam; a tenth arm having one end rotatably coupled to said end of said eighth arm; and an eleventh arm having one end rotatably coupled to said end of said ninth arm and a second end rotatably coupled to a second end of said tenth arm.

7. The printing machine of claim 1 wherein said water duct roller control mechanism comprises a first cam fixed to said operating shaft, said first cam having a protrusion formed thereon; a sub lever having a roller at one end thereof disposed to ride upon said first cam; a rotatably mounted first lever having said sub lever rotatably mounted at one end thereof; a first spring coupled between said sub lever and said first lever; a first link having a first end rotatably coupled to a second end of said first lever; a second shaft; a second lever pivotally mounted on said shaft; a first arm having a first end fixed to said second shaft, a second end of said first link being rotatably coupled to said second lever; a stop disposed adjacent a side of said second lever opposite said first link and a second spring for urging said second lever toward said stop; a second arm fixed to said second shaft; a latch loosely fitted on said second shaft; a third spring coupled between said latch and said second lever; a third lever rotatably mounted, said third lever having an engaging portion adapted to engage with said latch in a predetermined operative position thereof; a second cam having a different rotational ratio than a plate cylinder; a first roller rotatably mounted on a second end of said third lever and being disposed to ride on said second cam; a second link having a first end rotatably coupled to a third end of said third lever and a second end rotatably coupled to a second end of said first arm; a second roller rotatably coupled to a second end of said first arm; a third roller rotatably coupled to a second end of said second arm; a third cam rotatably mounted at one end thereof and having a first pin rigidly coupled to a second end thereof, said first pin being disposed between said second and third rollers and urging said second and third rollers apart from one another; a frame; a duct roller and a fountain roller rotatably mounted on said frame; a fourth arm fixed to said second shaft at one end thereof; a second pin rigidly coupled to a second end of said fourth arm and abutting an edge of said frame, wherein movement of said third arm controls an angle between said first and second arms to vary a rocking position of said fourth arm and wherein rotation of said second cam causes said duct roller to contact a distribution roller to supply water to said distribution roller.

8. The printing machine of claim 1 wherein said plate cylinder control mechanism comprises a first cam fixed to said operating shaft; a rotatably mounted cam lever having a first end disposed to ride on said first cam; a first link having one end rotatably coupled to a second end of said cam lever; a rotatable lever having a first end rotatably coupled to a second end of said first link; a first spring having one end coupled to a second end of said rotatable lever for urging said first end of said rotatable lever in the direction of said first link; a rotatable latch rotatable upon the same point as said rotatable lever; a third lever rotatably mounted upon the same point as said rotatable lever and said rotatable latch; a second spring coupled between said rotatable latch and said third lever; a pin rigidly coupled to an end portion of said third lever and being disposed to abut said first end of said rotatable lever in a predetermined operative position thereof; a fourth lever fixedly mounted to a plate cylinder shaft, said fourth lever having an engaging portion adapted to engage with an engaging portion of said rotatable latch; and an operating link rotatably coupled to said fourth lever for controlling an operational position thereof.

9. The printing machine of claim 1 wherein said sheet feed control mechanism comprises a control arm rigidly coupled to said operating shaft; a first arm having a first end engaged with said control cam wherein said first arm is turned upon rotation of said operating shaft; a first link having a first end rotatably coupled to a second end of said first arm; a rotatably mounted auxiliary operating lever, a second end of said first link being rotatably coupled to said auxiliary operating lever; a second arm having a latch and being adapted to engage with said auxiliary operating lever; a second lever having an end portion adapted to be engaged by an engaging portion of said latch; and a suction foot for controlling sheet feeding coupled to said second lever to be positioned by said second lever.

10. The printing machine of claim 9 further comprising a second link having a first end rotatably coupled to said first arm at a position near said first end of said first link; and a third lever coupled to said second link for controlling a position of said first arm.

11. The printing machine of claim 1 wherein said ink duct roller control mechanism comprises a first cam fixed to said operating shaft; a rotatable cam lever having one end riding upon said first cam; a first link having a first end rotatably coupled to a second end of said cam lever; a rotatably mounted bell arm having a first end rotatably coupled to a second end of said first link; a first pin rigidly secured to said bell arm; a second link having first and second elongated holes formed therein, said first pin being slidably disposed in said first hole; a first spring coupled between a first end of said second link and said first pin; a rotatably mounted latch having an engaging portion; a second pin fixed to said latch and slidably disposed in said second hole; a second spring extending between said latch and said second link; a second arm fixed to a first shaft, said second arm having an engaging end portion adapted to engage with said engaging portion of said latch; and a third arm fixed to said first shaft, an ink duct roller being rotatably mounted at an end of said third arm.

12. The printing machine of claim 5 wherein said operating lever has positions I through VI and wherein said first through fourth cams are disposed such that operating positions of said first through third switches are defined by:

| | Operating Lever Position | | | | | |
|---|---|---|---|---|---|---|
| | I | II | III | IV | V | VI |
| First Switch | OFF | ON | ON | ON | ON | ON |
| Second Switch | OFF | OFF | ON | ON | ON | ON |
| Third Switch | OFF | ON | OFF | OPF | OFF | OFF |

13. The printing machine of claim 12 wherein said switch mechanism comprises first through ninth relays;

a timer; first and second motors, said first motor being an operating motor of said printing machine and said second motor being a sheet feeding pump motor; an automatic-manual change-over switch; and said first through fifth switches; wherein, said third relay has a normally open contact coupled in series with said first motor between first and second power source terminals, said first relay having a normally open contact coupled in series with said second motor between said first and second power source terminals, said automatic-manual change-over switch having first and second switch sections each of which has an armature contact and manual and automatic pole contacts, said armature contact of said first switch section being coupled to said first terminal of said power source, said first relay having a coil coupled between said manual pole contact of said first switch section and said second power source terminal and through a normally open contact of said ninth relay to said automatic pole contact of said first switch section, said fourth relay having a first normally open contact coupled between said first power source terminal and said automatic pole terminal of said second switch section, said eighth relay having a first normally open contact coupled between said automatic pole terminal of said first switch section and said automatic pole terminal of said second switch section, said third relay having a coil coupled between said armature contact of said second switch section and said second power source terminal, said manual pole terminal of said second switch section being coupled to said first power source terminal, said eighth relay having a second normally open contact having one pole coupled to said armature contact of said second switch section, said timer having a first switch section having a first pole coupled to said armature contact of said second switch section, said third switch having first and second sections each having a first pole coupled to a second pole of said eighth relay, a second pole of said first section of said third switch being coupled to a second pole of said first section of said timer and to a first terminal of said first solenoid, a second terminal of said first solenoid being coupled to said second power source terminal, an operating coil of said timer having a first terminal coupled to a second pole of said second section of said third switch and a second terminal coupled to said second power source terminal, said sixth relay having a normally open contact having one pole coupled to said second pole of said second section of said third switch and a second pole coupled to a first terminal of a plate unloading solenoid, said plate unloading solenoid having a second terminal coupled to said second power source terminal, a first terminal of a blanket cylinder cleaning solenoid being coupled to said second pole of said second section of said third switch and a second terminal of said blanket cylinder cleaning solenoid being coupled to said second power source terminal, said second switch having a first pole coupled to said first power source terminal and a second pole coupled to a first terminal of a coil of said ninth relay, a second terminal of said coil of said ninth relay being coupled to said second power source terminal, said first switch having a first pole coupled to said first power source terminal and a second pole coupled to a first terminal of a coil of said fourth relay, a second terminal of said coil of said fourth relay being coupled to said second power source terminal, said timer having a second switch section having a first pole coupled to said first terminal of said power source, said fourth relay having a second normally open contact having a first pole coupled to a second pole of said second section of said timer and a second pole coupled to a first pole of a normally open contact of said ninth relay, a sixth switch having a position determined by a type of said loading plate being loaded and unloaded, said sixth switch having a first section having a first pole coupled to a second pole of said normally open contact of said ninth relay and a second pole coupled to a first pole of a first normally closed contact of said sixth relay, a second pole of said first normally closed contact of said sixth relay being coupled to a first terminal of said second solenoid, a second terminal of said second solenoid being coupled to said second power source terminal, said fourth switch having a first pole coupled to said second pole of said normally open contact of said ninth relay and a second pole coupled to a first terminal of a coil of said fifth relay, a second terminal of said coil of said fifth relay being coupled to said second power source terminal, said sixth relay having a second normally closed contact having a first pole coupled to said second pole of said fourth switch and a second pole coupled to a first terminal of a solenoid adapted to operate a plate gripping member, a second terminal of said solenoid adapted to operate said plate gripping member coupled to said second terminal of said power source, said fifth relay having a normally open contact having a first pole coupled to said second pole of said normally open contact of said ninth relay and a second pole coupled to a first pole of said fifth switch, said fifth switch having a second pole coupled to a first terminal of a coil of said sixth relay, a second terminal of said coil of said sixth relay being coupled to said second power source terminal, said sixth relay having a first normally open contact having a first pole coupled to said first pole of said fifth switch and a second pole coupled to said second pole of said fifth switch, a second section of said sixth switch having a first pole coupled to said second pole of said normally open contact of said ninth relay and a second pole coupled to a first pole of a second normally open contact of said sixth relay, a second pole of said second normally open contact of said sixth relay being coupled to a first terminal of a coil of said seventh relay, a second terminal of said coil of said seventh relay being coupled to said second power source terminal, a first normally open contact of said seventh relay having a first pole coupled to said first pole of said second normally open contact of said fourth relay and a second pole coupled to said second pole of said normally open contact of said ninth relay, said seventh relay having a second normally open contact having a first pole coupled to said second pole of said normally open contact of said ninth relay and a second pole coupled to said second pole of said second normally open contact of said sixth relay, said timer having a switch adapted to be closed after a predetermined number of sheets has been counted, said switch of said timer having a first pole coupled to said second pole of said normally open contact of said ninth relay and a second pole coupled to a first terminal of a coil of said eighth relay, a second terminal of said coil of said eighth relay being coupled to said second power source terminal, and said eighth relay having a normally open contact having a first pole coupled to said second pole of said normally open contact of said ninth relay and a second pole coupled to said second pole of said switch of said timer.

* * * * *